United States Patent [19]

Foster

[11] 3,954,220

[45] May 4, 1976

[54] LITTER FREE ECOLOGY BOX

[76] Inventor: John Paul Foster, 550 Shorely Drive, Barrington, Ill. 60610

[22] Filed: Feb. 24, 1975

[21] Appl. No.: 552,548

[52] U.S. Cl. ..... 229/27; 229/15; 229/51 D

[51] Int. Cl.[2] ..... B65D 5/48

[58] Field of Search ..... 229/27, 51 D, 15, 28 R

[56] References Cited

UNITED STATES PATENTS

| | | | |
|---|---|---|---|
| 2,074,160 | 3/1937 | Bergstein | 229/27 |
| 2,983,421 | 5/1961 | Turpin | 229/27 |
| 3,166,229 | 1/1965 | Sherman et al. | 229/27 |
| 3,185,048 | 5/1965 | Struble | 229/27 X |
| 3,370,776 | 2/1968 | Krzyzanowski | 229/27 |

*Primary Examiner*—William Price
*Assistant Examiner*—Stephen P. Garbe
*Attorney, Agent, or Firm*—Leo J. Aubel; Gerald T. Shekleton

[57] ABSTRACT

A disposable container for the storage of foodstuffs having inedible parts or wrappers, whereby the container is divided into two separate compartments, each compartment having perforations for the forming of an opening therein. The opening in one of the compartments serves as an access point for the foodstuffs contained within, and the hole in the other compartment serves to allow the entrance of the inedible portions and/or wrappings of the foodstuffs into the second compartment for disposal.

3 Claims, 4 Drawing Figures

LITTER FREE ECOLOGY BOX

BACKGROUND OF THE INVENTION

This invention relates in general to a method of merchandising foodstuffs, and in particular, to a container for marketing foodstuffs having inedible portions, and/or wrappings and with a self-contained means for disposal of these portions.

In view of the contemporary ecology movement, and ever increasing demands for a cleaner environment, a need has surfaced for a means to effectively contain and dispose of waste of all sorts. A particular problem surfaces at places of entertainment, such as amusement parks, sports areans, and the like, where items such as taffy and peanuts are sold and the wrappings and shells are strewn over the grounds, thereby necessitating large maintenance expenses. Peanuts are especially a maintenance problem, as the shells remaining after consumption of the peanut constitute the same volume as before consumption and may not easily be stuffed into pockets, purses or other normal temporary means of disposal for candy wrappers, etc.

The present invention alleviates this problem by providing a source of immediate disposal for the waste products of the various foodstuffs. This invention is easy to manufacture, inexpensive and pragmatic, thereby making it appealing to merchandisers whose approval constitutes an essential part of any scheme in the realm of individual consumption to clean up the enviroment. To accomplish these objectives, the container has two distinct and separate compartments, one of these compartments being for the storage of the particular foodstuffs which are to be sold, the other for the retention of the inedible or waste portions subsequently separated from the edible portions.

Access to each compartment is effected by applying pressure to an area outlined by perforations. Having made an opening in each compartment in this way, the foodstuffs in the one compartment may be withdrawn, consumed, and the edible portions described in the compartment opposite the first. In this manner, waste can be retained inside the container for later disposal into a receptacle designated for such purposes, and a small, but significant contribution to a clean enviroment is accomplished.

SUMMARY OF THE INVENTION

It is therefore an object of this invention to help maintain a clean enviroment.

Further, another object of the present invention is to serve as a container for both the edible and subsequent inedible portions of foodstuffs.

Another object of the present invention is to make disposal of the inedible portions of certain foodstuffs clean, easy and attractive to the ordinary person.

Still another object of the present invention is the easy and inexpensive manufacture of a novel and easily marketable container for foodstuffs.

DESCRIPTION OF THE DRAWINGS

Further objects of the invention together with additional features contributing thereto and advantages accruing therefrom will be apparent from the following description of one embodiment of the invention when read in conjunction with the accompanying drawings wherein.

DESCRIPTION OF THE INVENTION

Figure 1:
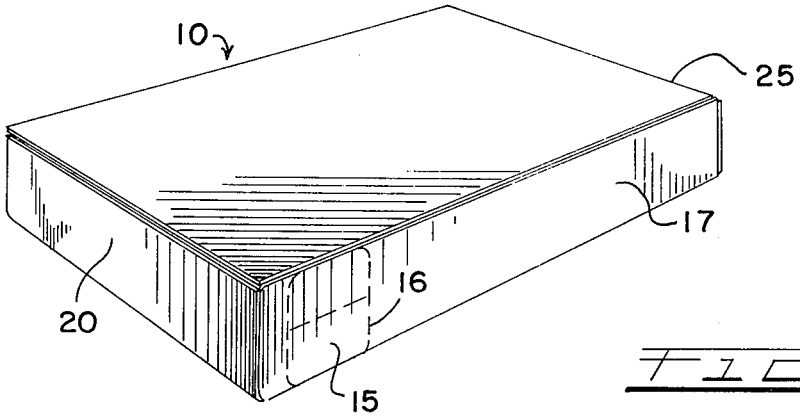
FIG. 1 is a perspective view of one embodiment of the present invention.
Figure 3:
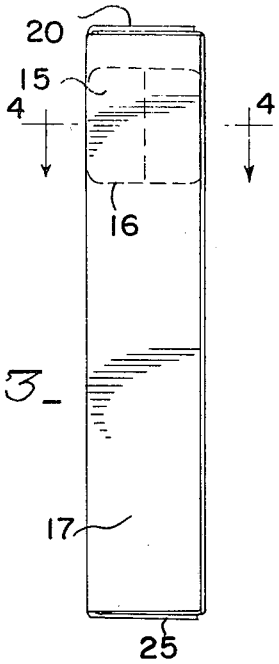
FIG. 3 is a side view of a preferred embodiment of the present invention.
Figure 4:
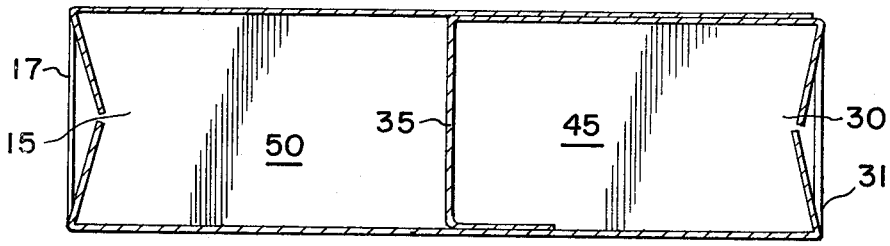
FIG. 4 is a cross section of the preferred embodiment of the present invention taken at line 4—4 of FIG. 3.

Referring now to FIGS. 1 and 3, the present invention encompasses a container 10, which includes a top 20 and a bottom 25, with sides 17 and 31. In FIG. 3, it can be seen that on the side 17 are perforations 16 outlining an area 15 which opens under the pressure of a thumb or finger to provide access to the contents within; as can be seen in FIG. 4, a similar opening 30 having similar perforations 16 are broken, the access area 15 appears much like swinging cafe doors, hinged on the outside edges of the container. In one embodiment, the box 10 is eight inches in heighth, 6 inches in width and 2 inches in depth. In the embodiment, the opening 15 measures 1 ¾ inches in heighth and 1 ¼ inches in width, while opening 30 measures 1 ¼ inches in heighth and 1 ¼ inches in width.

FIG. 4 also shows that the container 20 is divided into two separate and distinct parts, 45 and 50, by a barrier or partition 35; this partition 35 contstitutes an integral part of the box, and therefore cannot change position or disassociate itself from the box. This barrier 35 can be placed at any point in the container, so as to divide it into any fractional volumes desired. In view of the varying ratios of the volumes before and after consumption of particular food products, this feature is very desirable. For instance, candy wrappers constitute a small fraction of the volume of the candy that is wrapped. Therefore, a smaller waste compartment is desirable, which parenthetically, allows the container to hold more candy. On the other hand, when peanuts are involved as already stated, the volume of the peanut shells equals the volume of unconsumed peanuts while still in the shell; therefore, the barrier in this use is preferably placed at the midpoint of the box to be most effective.

Figure 2:
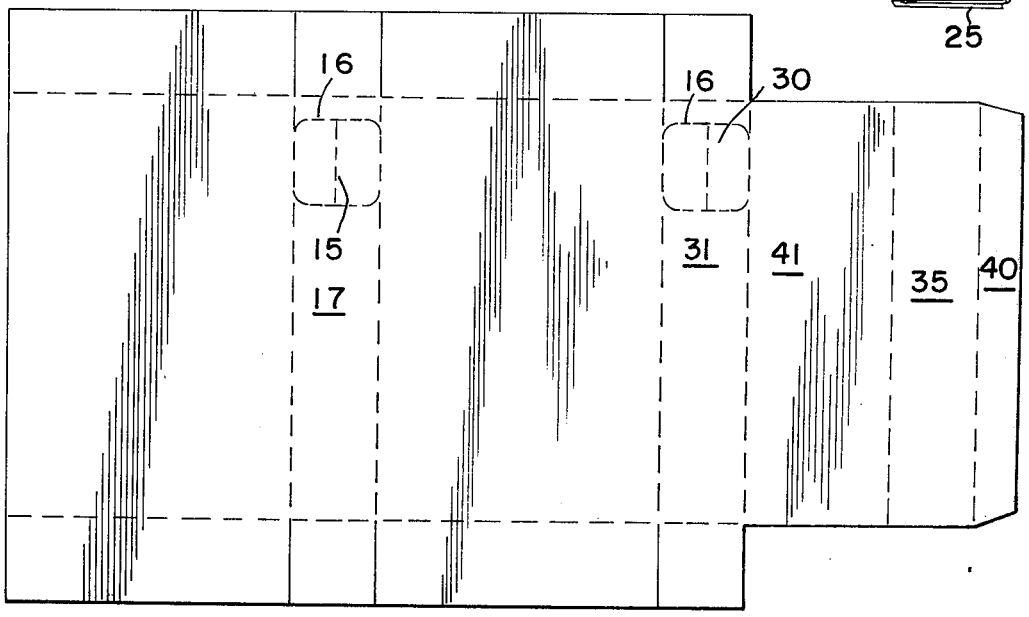
FIG. 2 shows a single sheet of material from which an embodiment of the present invention is constructed.

The container 10 is constructed by folding along the lines of the various creases and folds shown in dotted lines on the single sheet of material in FIG. 2, using appropriate glues or other suitable fastening substances on the surfaces 40 and 41. The top and bottom flaps 20 and 25 are folded and fastened in the same manner, thereby sealing the contents within. In this manner, a container of rigid construction is easily assemblied with two distinct compartments while providing access to each compartment. While a single sheet is shown to be one manner of construction of the novel container, other modes involving various pieces of material are contemplated to be within the scope of this invention. The method shown is one in which is convenient and inexpensive to manufacture, and therefore, is preferable to other methods. The materials contemplated for use in the present invention are those rigid materials normally used in the packaging of foodstuffs, i.e., cardboard, appropriate plastics or similar materials. These materials may have an outer wrapping of waxed paper or plastic with designs, trade names and trademarks imprinted upon them as is customary in the trade.

As mentioned above, the product is contained within compartment 50 and the waste product is deposited within compartment 45 of box 10. In one embodiment, the box 10 is used for peanuts and the opening or area 15 for side 17 is relative larger than the opening or area 30 for side 31 for thus permitting easier dispensing of the peanuts.

After breaking openings for areas 15 and 30, the product within is shaken or poured out in any quantity desired, and consumed. Should this product be a peanut, for example, the shell then remains after consumption. The empty shell would then be placed in the opposite side of the box for disposal; or the shells can subsequently be deposited in appropriate areas since peanut shells are good for the soil. Should the product be taffy, the wrappings would remain upon consumption of the taffy, which would then be placed in the opposite side. Having consumed the foodstuffs in this manner, the container is then tossed into a waste receptacle. The grounds are cleaner, the enviroment is healthier and maintenance costs are reduced.

While the invention has been particularly shown and described with reference to preferred embodiments thereof, it will be understood by those skilled in the art that various changes in form and details may be made therein without departing from the spirit and scope of the invention.

What is claimed is:

1. A container, for the distribution and sale of foodstuffs for consumption containing a first compartment substantially identical to a second compartment, each of said compartments being separated from the other of said compartments by a partition, so as to form distinct and separate compartments, and the first of said compartments having a formable opening of sufficient size to permit access to said foodstuffs contained within the first of said compartments by manipulation of the users fingers, said second compartment having a formable opening to permit disposal of a waste product within, said waste product derived from the consumption of said foodstuffs subsequent to removal from said container each of said openings being initially closed and comprising a rectangular area having a first set of opposing sides a second set of opposing sides, and a medial line of perforations was inserted, each of said first sides comprising a scoreline to permit easy flexing at said scoreline, each of said second sides being perforated to permit said opening to be formed by the application of slight pressure by the user's thumb, said medial line extending from one of said second sides to the other, said score lines and said perforated lines forming two doors hingedly connected to the remainder of said container along said score lines.

2. The container of claim 1 wherein said compartments are integrally formed of a continuous sheet of material.

3. The container of claim 1 wherein said material is formed of cardboard.

* * * * *